US007093320B2

(12) United States Patent
Tager

(10) Patent No.: US 7,093,320 B2
(45) Date of Patent: Aug. 22, 2006

(54) PIN-LESS LOCKS FOR SLIDING MEMBERS

(76) Inventor: Jean M. Tager, 1211 Stonewall Tr., Heath, TX (US) 75032

( * ) Notice: Subject to any disclaimer, the term of this patent is extended or adjusted under 35 U.S.C. 154(b) by 584 days.

(21) Appl. No.: 09/682,635

(22) Filed: Oct. 1, 2001

(65) Prior Publication Data

US 2002/0007531 A1 Jan. 24, 2002

(51) Int. Cl.
*E05F 5/02* (2006.01)

(52) U.S. Cl. ..... 16/82; 16/86 B; 16/402; 16/86 A; 292/DIG. 7; 292/DIG. 9; 292/DIG. 15; 292/298; 292/DIG. 46

(58) Field of Classification Search ..... 16/82, 16/86 B, 402, 86 R, 86 A; 292/304, 338, 292/DIG. 7, DIG. 9, DIG. 15, DIG. 17, 202, 292/204, 209, 297, 298, DIG. 46, DIG. 38; 49/449, 450, 451
See application file for complete search history.

(56) References Cited

U.S. PATENT DOCUMENTS 2,629,466 A * 2/1953 Nardulli
2,855,772 A * 10/1958 Hillgren ..... 70/100
2,920,914 A * 1/1960 Jenkins ..... 292/67
3,174,783 A * 3/1965 Russell
3,625,557 A * 12/1971 Jensen ..... 292/128
3,661,413 A * 5/1972 Silva ..... 16/82
3,837,693 A 9/1974 Adickes
4,171,835 A * 10/1979 Conley et al. ..... 292/288
4,300,795 A * 11/1981 Jennings ..... 292/257
4,428,605 A * 1/1984 Follows ..... 292/152
4,436,328 A * 3/1984 Chernosky ..... 292/241
4,715,644 A * 12/1987 Lobanoff et al. ..... 296/97.5
4,981,348 A * 1/1991 Prillard ..... 359/844
4,993,772 A * 2/1991 Charen ..... 296/97.1
5,059,016 A * 10/1991 Lawassani et al. ..... 359/871
5,117,073 A * 5/1992 Mischenko ..... 200/61.7
5,203,596 A * 4/1993 Stevens ..... 292/204
5,542,721 A * 8/1996 Allen ..... 292/194
5,649,309 A * 7/1997 Wilcox et al. ..... 455/575.3
5,927,997 A * 7/1999 Ruland et al. ..... 439/31
6,000,735 A * 12/1999 Jourdenais ..... 292/238
6,119,019 A * 9/2000 Phelps ..... 455/575.3
6,704,585 B1 * 3/2004 Hiebel ..... 455/575.3

FOREIGN PATENT DOCUMENTS

JP 411107607 * 4/1999

* cited by examiner

*Primary Examiner*—Brian E. Glessner
*Assistant Examiner*—Mark Williams

(57) ABSTRACT

A lock for overlapping parallel sliding members has a hinge member having two leaves. The two leaves include a fixed leaf permanently secured to one of overlapping sliding members, and a pivotal leaf pivotally moveable between locked and unlocked positions, to permit sliding of said overlapping members in the unlocked position, and, when turned an about 90 degree angle to the locked position, to abut the face of one of said overlapping members to prevent displacement there between. A resistance mechanism is provided for lightly-resisting pivoting of said pivotal leaf against displacement or rotation in the locked position, said resistance mechanism being indestructible in normal operation without pre-manipulation of any portion of the lock prior to pivoting movement.

5 Claims, 4 Drawing Sheets

PIN-LESS LOCKS FOR SLIDING MEMBERS

BACKGROUND OF INVENTION

The present invention generally relates to locks for overlapping parallel sliding members, such as sliding glass doors and windows, and more particularly to a hinge member having two leaf members, with the leaf members being pivotable between locked and unlocked positions.

U.S. Pat. No. 3,873,693 discloses a prior lock similar to the present invention for overlapping parallel sliding members, and the disclosure of said patent is incorporated herein as if fully set forth herein.

A significant drawback of the prior lock was its complex and expensive, yet non-intuitive and delicate, detent pin. The necessity of withdrawing the spring loaded pin prior to pivoting the leaves was not immediately apparent. Persons unfamiliar with the operation of the prior lock would typically force the lock open without first withdrawing the pin, thereby breaking the pin.

Thus, an object of this invention is to provide a simple inconspicuous element attached to one member of overlapping parallel sliding members, which may be positioned to permit free sliding of the overlapping members with respect to each other, and positioned in another position to obstruct or prevent movement of said overlapping sliding members with respect to each other.

A further object of this invention is to provide a hinge type member having one leaf thereof permanently secured to one of overlapping sliding members, and the second leaf thereof pivotal between locked and unlocked positions to permit sliding of said overlapping members in the unlocked position; and, when turned a 90 degree angle to the locked position, to abut the face of one of said overlapping members to prevent displacement there between; and, a resistance mechanism for lightly-resisting pivoting of said pivotal leaf member against displacement or rotation, the resistance mechanism being indestructible in normal operation without pre-manipulation of any portion of the lock prior to pivoting movement.

A still further object of this invention is to provide a device as described which will be simple and economical in construction and efficient and durable in use.

SUMMARY OF INVENTION

A lock for overlapping parallel sliding members has a hinge member having two leaves. The two leaves include a fixed leaf permanently secured to one of overlapping sliding members, and a pivotal leaf pivotally moveable between locked and unlocked positions, to permit sliding of said overlapping members in the unlocked position, and, when turned an about 90 degree angle to the locked position, to abut the face of one of said overlapping members to prevent displacement there between. A resistance mechanism is provided for lightly-resisting pivoting of said pivotal leaf against displacement or rotation in the locked position, said resistance mechanism being indestructible in normal operation without pre-manipulation of any portion of the lock prior to pivoting movement.

BRIEF DESCRIPTION OF DRAWINGS

A more complete understanding of the invention and its advantages will be apparent from the Detailed Description taken in conjunction with the accompanying Drawings, in which.

DETAILED DESCRIPTION

Figure 1:
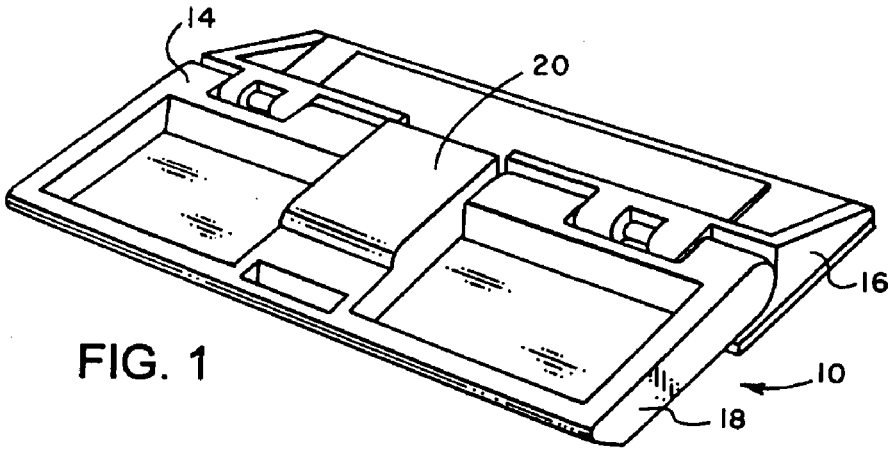
FIG. 1 is a right-front perspective view of the lock of the present invention in the unlocked position.
Figure 2:
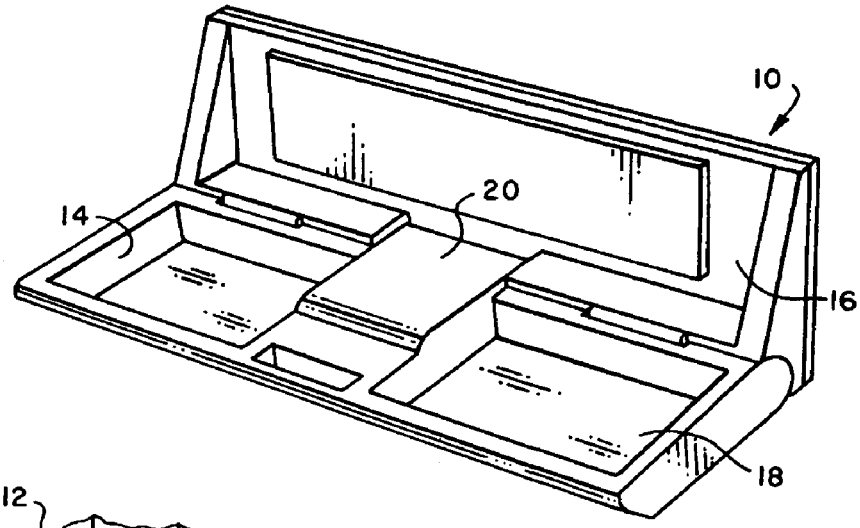
FIG. 2 is a view similar to FIG. 1 in the locked position.
Figure 3:
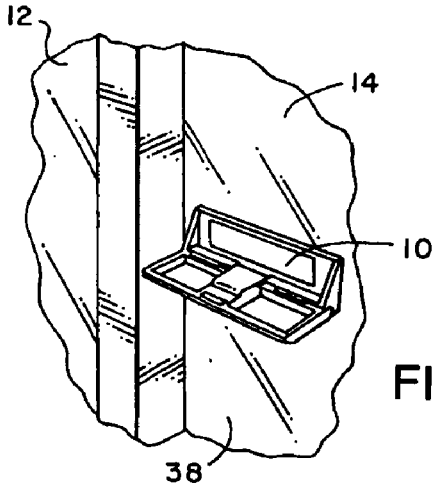
FIG. 3 is a right-front perspective view of the lock of the present invention installed on a sliding glass door, in the locked position.
Figure 4:
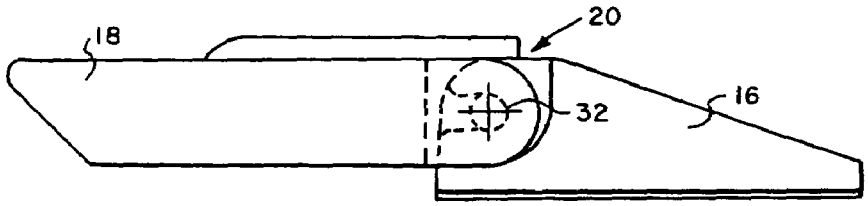
FIG. 4 is a side view of the lock of the present invention in the unlocked position.
Figure 5:
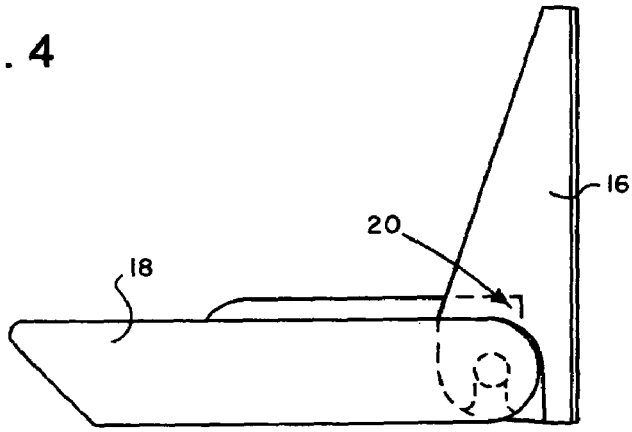
FIG. 5 is a view similar to FIG. 1 in the locked position.
Figure 6:
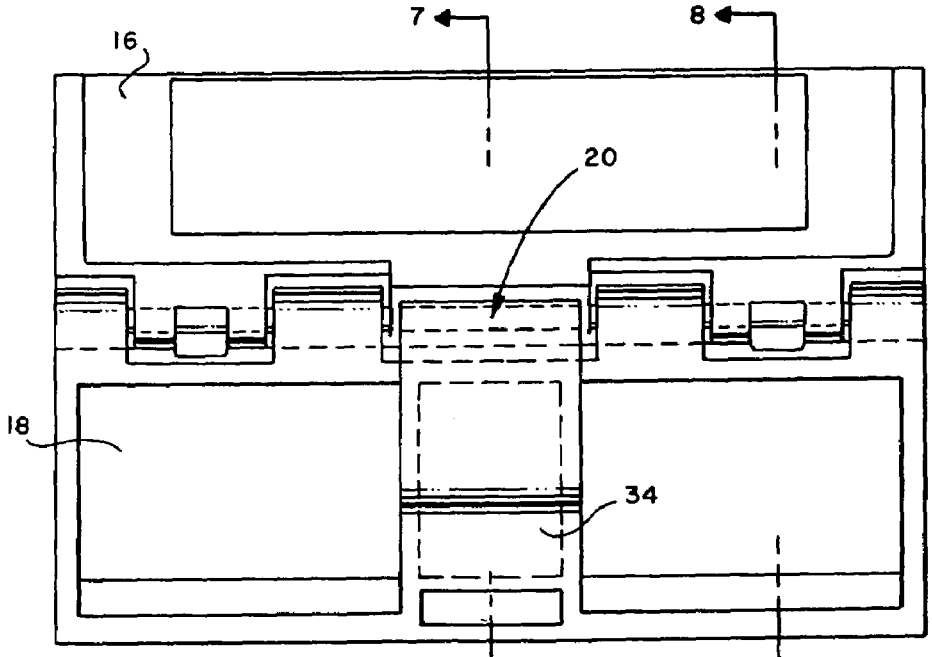
FIG. 6 is a top view of the lock of the present invention in the unlocked position.
Figure 7:
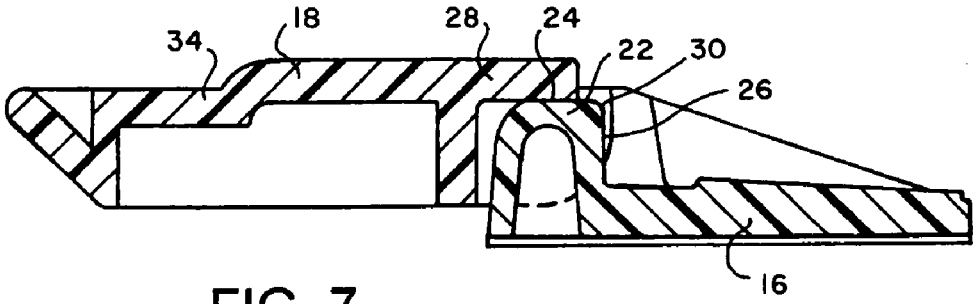
FIG. 7 is a sectional view taken along lines 7—7 of FIG. 6.
Figure 8:
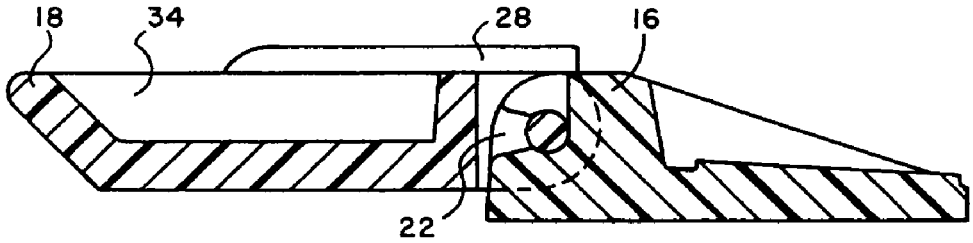
FIG. 8 is a sectional view taken along lines 8—8 of FIG. 6.

Referring initially to FIGS. 1–6, where like numerals indicate like and corresponding elements,a lock 10 is provided for overlapping parallel sliding members, for example, sliding doors 12 and 14 of FIG. 3.

Lock 10 includes a hinge member 14 having two leaves 16, 18. The two leaves 16, 18 include a fixed leaf 16 permanently secured to one of overlapping sliding members, for example, door 14 in FIG. 3, and a pivotal leaf 18 pivotally moveable between locked and unlocked positions.

The lock is constructed such that the pivotal leaf permits sliding of the overlapping members in the unlocked position, and, when turned an about 90 degree angle to the locked position, to abut the face of one of said overlapping members as shown in FIG. 3 to prevent displacement there between. It will be understood that the lock may also be used with overlapping windows in addition to doors, with the lock generally vertical as opposed to generally horizontal as shown in FIG. 3.

A resistance mechanism 20 is provided for lightly-resisting pivoting of the pivotal leaf 18 against displacement or rotation in the locked position. The resistance mechanism 20 is indestructible in normal operation without pre-manipulation of any portion of the lock prior to pivoting movement.

In one embodiment, the resistance mechanism is two-state, providing for lightly-resisting pivoting of said pivotal leaf against displacement or rotation in both the locked and unlocked positions. It will be appreciated that resistance against pivoting is only necessary in the locked position, for security reasons. Resistance to pivoting in the unlocked position is ordinarily desirable in order to prevent accidental locking and to present the user with a tactile indication that the lock is unlocked.

Referring now to FIGS. 7–12, in one embodiment, the resistance mechanism 20 includes a cam 22 on one of said leaves 16, 18. Cam 22 has at least one, and preferable at least two, flattened lobes 24, 26. Flattened lobes 24, 26 are disposed about 90 degrees apart on cam 22. At least one flattened lobe, lobe 26, corresponds to the locked position, and where there are at least two lobes, the other flattened lobe, lobe 24, corresponds to the unlocked position. A displaceable follower 28 on the other leaf is engaged with the cam 22 for providing light resistance to pivoting relative movement of the leaves when said follower 28 is engaged with either one of said flattened lobes 24, 26.

In the illustrated embodiment, the cam 22 is located on the fixed leaf 16 and the follower 28 is located on the pivotal leaf 18, though a reversed arrangement is possible with equivalent effect.

Figure 9:
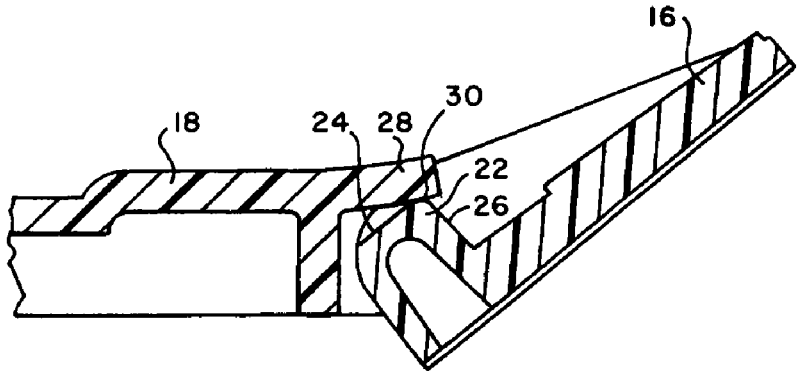
FIG. 9 is a partial view similar to FIG. 7 showing the leaves in between the locked and unlocked positions.
Figure 10:
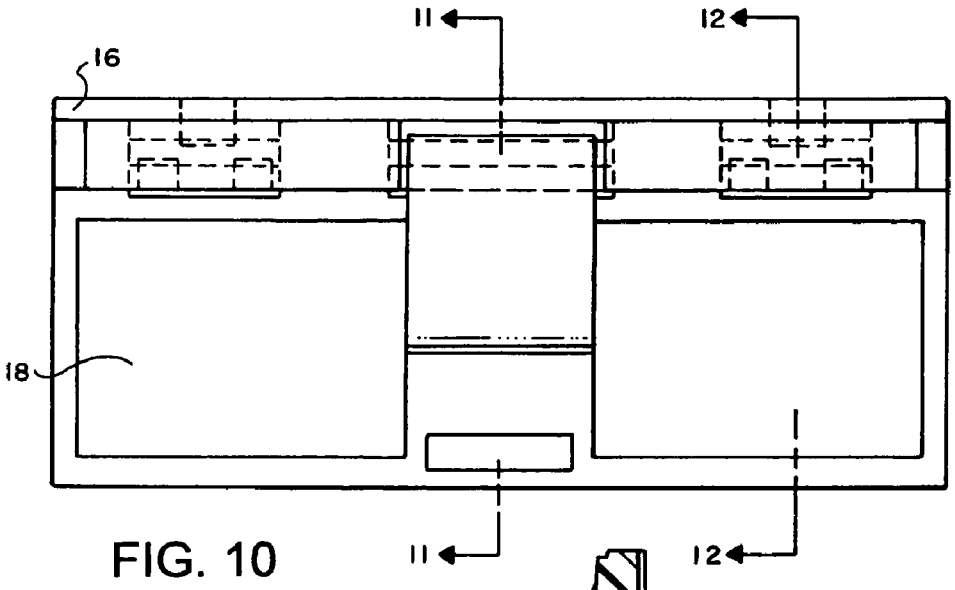
FIG. 10 is a bottom view of the lock of the present invention in the locked position.
Figure 11:
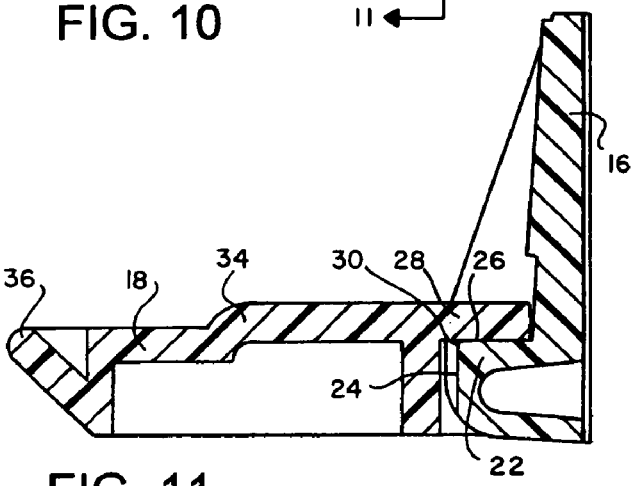
FIG. 11 is a sectional view taken along lines 11—11 of FIG. 10.
Figure 12:
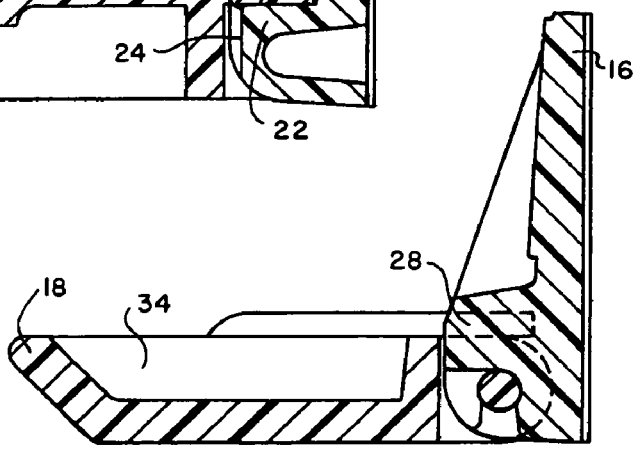
FIG. 12 is a sectional view taken along lines 12—12 of FIG. 10.

In one embodiment, follower 28 is formed of a deformable material such as thermoplastic resin. Then, the follower 28 is dimensioned to permit increased elastic deformation thereof by the cam 22 during pivoting relative movement of the leaves, as best shown in FIG. 9.

Cam 22 has a rounded corner 30 between flattened lobes 24, 26. Rounded corner 30 is displaced radially from the hinge axis 32 (FIG. 4) of the leaves a greater amount than the flattened lobes 24, 26, so that follower 28 is increasingly deformed when by pivoting movement it comes in contact with rounded corner 30. In one embodiment follower 28 is non-deformed, i.e., in its free-standing state, when the pivotal leaf is in the locked and unlocked position and with follower 28 just touching but not deformed by flattened lobes 24, 26. It will be understood that the device may also be constructed with the follower being deformed a lesser amount in the locked and unlocked positions, but being more greatly deformed in between.

In one embodiment, the follower 28 extends from a raised central portion 34 of the pivotal leaf, which enables symmetric loading of the leaves and their hinge structures. It will be recognized that a resistance mechanism with a similar function could be formed with equivalent yet different structure.

In one embodiment, the pivotal leaf 18 has having an outer longitudinal edge 36 (FIG. 11) sloped outwardly away from a hinge axis 32 of the leaves 16,18 and a surface 38 (FIG. 3) of the sliding member (door or window) adjacent to the pivotal leaf 18 when the pivotal leaf 18 is in the unlocked position. This enables ease in getting the end of a finger in position to move the pivotal leaf 18 when it is in the unlocked position next to surface 38.

The entire lock may be made of injection-molded polycarbonate, though other materials will also be suitable.

In operation, the locked position is illustrated in FIGS. 2, 3, 5, 10, 11 and 12, while the unlocked position is illustrated in FIGS. 1, 4, 6, 7, and 8. FIG. 9 illustrates the lock with the leaves 16, 18 in between the locked and unlocked positions, although it is possible, depending on the location of the lock, to achieve locking in the position of FIG. 9. Preferably, though not necessarily, a position like FIG. 9 is not a steady-state configuration of the lock.

The resistance mechanism 20 is provided for lightly-resisting pivoting of the pivotal leaf 18 against displacement or rotation in the locked position. "Lightly-resisting" is, of course, a relative term, and in this context is defined to mean resistance firm enough to prevent movement of the pivotal member 16 by wind vibration, pet contact, or repeated, determined attempts by an intruder to open the locked door or window from outside, yet light enough to permit ready and comfortable manipulation by the inside user.

In contrast to the prior locks with spring-loaded pins, the resistance mechanism of the present invention is indestructible in normal operation without pre-manipulation of any portion of the lock prior to pivoting movement. Thus, where the prior lock required pre-manipulation of the spring-loaded pin to prevent its destruction, in contrast, the present lock may be directly moved between locked and unlocked positions, and vice versa, indefinitely, without any preliminary manipulation at all and without destruction of any part of the resistance mechanism.

It will be understood that each of the elements described above, or two or more together, may also find a useful application in other types of constructions differing from the type described above.

While the invention has been illustrated and described as embodied in a lock for parallel overlapping members, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

Whereas, the present invention has been described with respect to a specific embodiment thereof, it will be understood that various changes and modifications will be suggested to one skilled in the art and it is intended to encompass such changes and modifications as fall within the scope of the appended claims.

The invention claimed is:

1. A lock in combination with overlapping parallel sliding members, said lock comprising:

a hinge member having two leaves;

the two leaves including a fixed leaf permanently secured to one of overlapping sliding members, and a pivotal leaf pivotally moveable between locked and unlocked positions, to permit sliding of said overlapping members in the unlocked position, and, when turned about 90 degrees to the locked position, to abut the face of one of said overlapping members to prevent displacement there between; and a resistance mechanism for lightly-resisting pivoting of said pivotal leaf against displacement or rotation in the locked position, said resistance mechanism requiring no pre-manipulation of any portion of the lock prior to pivoting movement;

wherein the resistance mechanism provides for lightly-resisting pivoting of said pivotal leaf against displacement or rotation in both the locked and unlocked positions;

wherein said resistance mechanism comprises a cam on one of said leaves having at least one flattened lobe, the at least one flattened lobe corresponding to the locked position, and a displaceable follower on the other leaf engaged with the cam for providing light resistance to pivoting relative movement of the leaves when said follower is engaged with said flattened lobe;

wherein the follower has a planar surface engaged with the cam, the planar surface being engageable with the at least one flattened lobe of cam when the pivotal leaf is in the locked position; and wherein the follower is formed of a deformable material, and the follower is dimensioned to permit increased elastic deformation thereof by the cam during pivoting relative movement of the leaves;

the follower extending from a raised central portion of the pivotal leaf.

2. The device of claim 1 with a central location located in abutting inner longitudinal edges of the leaves, and the cam and follower being located in the central location.

3. The device of claim 1 with the pivotal leaf having an outer longitudinal edge sloped outwardly away from a hinge axis of the leaves and a surface of the sliding member adjacent to pivotal leaf when the pivotal leaf is in the unlocked position.

4. A lock in combination with overlapping parallel sliding members, said lock comprising:

a hinge member having two leaves;

the two leaves including a fixed leaf permanently secured to one of overlapping sliding members, and a pivotal leaf pivotally moveable between locked and unlocked positions, to permit sliding of said overlapping members in the unlocked position, and, when turned about 90 degrees to the locked position, to abut the face of one of said overlapping members to prevent displacement there between;

a resistance mechanism for lightly-resisting pivoting of said pivotal leaf against displacement or rotation in the locked position, said resistance mechanism requiring no pre-manipulation of any portion of the lock prior to pivoting movement;

wherein said resistance mechanism comprises a cam on one of said leaves having at least one flattened lobe, the at least one flattened lobe corresponding to the locked position, and a displaceable follower on the other leaf engaged with the cam for providing light resistance to pivoting relative movement of the leaves when said follower is engaged with said flattened lobe;

wherein the follower has a planar surface engaged with the cam, the planar surface being engageable with the at least one flattened lobe of cam when the pivotal leaf is in the locked position;

wherein the cam is located on the fixed leaf and the follower is located on the pivotal leaf;

wherein the follower is formed of a deformable material, and the follower is dimensioned to permit increased elastic deformation thereof by the cam during pivoting relative movement of the leaves;

with the follower being non-deformed when the pivotal leaf is in the locked position;

with the cain and follower being centrally located in abutting inner longitudinal edges of the leaves;

with the follower extending from a raised central portion of the pivotal leaf; and with the pivotal leaf having an outer longitudinal edge sloped outwardly away from a hinge axis of the leaves and a surface of the sliding member adjacent to pivotal leaf when the pivotal leaf is in the unlocked position.

5. A lock in combination with overlapping parallel sliding members, said lock comprising:

a hinge member having two leaves;

the two leaves including a fixed leaf permanently secured to one of overlapping sliding members, and a pivotal leaf pivotally moveable between locked and unlocked positions, to permit sliding of said overlapping members in the unlocked position, and, when turned about 90 degrees to the locked position, to abut the face of one of said overlapping members to prevent displacement there between;

a resistance mechanism for lightly-resisting pivoting of said pivotal leaf against displacement or rotation in the locked position, said resistance mechanism requiring no pre-manipulation of any portion of the lock prior to pivoting movement, wherein the resistance mechanism provides for lightly-resisting pivoting of said pivotal leaf against displacement or rotation in both the locked and unlocked positions;

wherein said resistance mechanism comprises a cam on one of said leaves having at least two flattened lobes, at least one flattened lobe corresponding to the locked position and at least one other flattened lobe corresponding to the unlocked position, and a displaceable follower on the other leaf engaged with the cam for providing light resistance to pivoting relative movement of the leaves when said follower is engaged with either one of said flattened lobes;

wherein the cam is located on the fixed leaf and the follower is located on the pivotal leaf;

wherein the follower is formed of a deformable material, and the follower is dimensioned to permit increased elastic deformation thereof by the cam during pivoting relative movement of the leaves;

with the follower being non-deformed when the pivotal leaf is in the locked and unlocked position;

with the follower extending from a raised central portion of the pivotal leaf; and with the pivotal leaf having an outer longitudinal edge sloped outwardly away from a hinge axis of the leaves and a surface of the sliding member adjacent to pivotal leaf when the pivotal leaf is in the unlocked position.

* * * * *